United States Patent [19]

Henderson

[11] Patent Number: 4,844,700

[45] Date of Patent: Jul. 4, 1989

[54] PRESSURE AMPLIFYING PUMP SYSTEM

[76] Inventor: Charles J. Henderson, 62 Yankee Peddler, Madison, Conn. 06443

[21] Appl. No.: 114,574

[22] Filed: Oct. 29, 1987

[51] Int. Cl.[4] ..... F04B 9/08

[52] U.S. Cl. ..... 417/225; 417/401

[58] Field of Search ..... 417/225, 401, 403, 404, 417/402, 400, 393

[56] References Cited

U.S. PATENT DOCUMENTS

| | | | |
|---|---|---|---|
| 217,626 | 7/1879 | Lyman | 417/225 |
| 657,160 | 9/1900 | Eads | 417/225 |
| 1,377,585 | 5/1921 | Johanson | 417/225 |
| 2,579,670 | 12/1951 | Hjarpe | 417/225 |
| 3,469,594 | 9/1969 | Porter | 417/401 X |
| 4,558,715 | 12/1985 | Walton et al. | 137/99 |
| 4,705,458 | 11/1987 | Laurent et al. | 92/98 D |

FOREIGN PATENT DOCUMENTS

| | | | |
|---|---|---|---|
| 5892 | of 1905 | United Kingdom | 417/401 |
| 567144 | 1/1945 | United Kingdom | 417/403 |

*Primary Examiner*—Leonard E. Smith
*Attorney, Agent, or Firm*—Henry M. Bissell

[57] ABSTRACT

A water pressure intensifying system for providing elevated water main pressure from water at a relatively low pressure head, such as may be available from a slowly flowing stream, for example. The basic system comprises two in-line cylinders of different diameters with the pistons being coupled together by a connecting rod. Associated valving directs water flow so that the low pressure water driving the large piston causes the small piston to produce water flow at substantially increased pressure. Multiple pumps can be driven in parallel in a companion pump battery from control valving associated with a single pump in a basic system, thus substantially reducing the cost of adding flow capacity to a basic pumping system of the invention. A modification of the system can be used as a proportional flow mixing system such as, for example, adding chlorine to a water supply in a municipal treatment plant.

19 Claims, 4 Drawing Sheets

PRESSURE AMPLIFYING PUMP SYSTEM

BACKGROUND OF THE INVENTION

This invention relates to hydraulic pumping systems and, more particularly, to such systems which are driven by flowing water at low head to develop a higher water pressure than that which is initially available.

Many systems have been developed for intensifying available fluid pressure to create an elevated fluid pressure without resort to the consumption of energy in a driving means to do the work of pressure intensification. In such systems of interest here, the fluid is liquid, normally water from a stream or other source which is available at relatively limited pressure head and which is utilized to provide a portion of the available water at an elevated pressure which may be several times the differential head pressure.

Systems of the type described may be broadly classified in two categories: those such as a hydraulic impulse ram system which makes use of the kinetic energy of water flowing in a pipe to raise part of the water to a higher level, and those which utilize intercoupled pistons/cylinders having different cross sectional areas which achieve pressure multiplication in proportion to the ratio of the respective piston areas. The systems of the present invention are of the latter category.

Systems of the latter category are exemplified in U.S. Pat. Nos. 217,626 to Lyman, 2,080,695 to Cargile, 2,579,670 to Hjarpe, 2,864,313 to Dawson and 2,896,542 to Forghieri. All of these disclose a pair of pistons of differing diameters mounted at opposite ends of a single connecting rod and operable in corresponding dual cylinder configurations. Control valve means are associated with these dual piston arrangements to supply and release water to and from the respective cylinders in appropriate synchronism so that the larger piston, operating at low relative pressure, drives the smaller piston, operating at increased relative pressure, to provide water at a pressure head substantially above that of the driving liquid which is available. The Hjarpe patent discloses two pairs of differential pistons operating in opposite phase to each other so that a more even pressure at the output of the system may be achieved.

All of the disclosed systems, except that of Dawson, utilize control valving arrangements which are mounted internally of their main piston housing. By means of these internal control valves, water from the associated low pressure source is alternately directed into the larger cylinder to drive the piston therein through the extent of its travel and then released from the larger cylinder while the dual pistons are returned to the bottom of their stroke by pressure from the source being applied to the smaller piston as its cylinder is filled with water for the next pressure amplifying stroke. During the release mode, water from the larger cylinder is typically returned to the stream from which it came by gravity flow.

The Dawson patent discloses a separate control valve in the form of a spool valve mounted in a separate chamber which is interconnected with the pressure intensifying chamber through a plurality of tubes. Water from the low pressure source is first directed to the spool valve chambers prior to being directed to the piston housing to drive the intensifying pump. Dawson's pump has a double acting main piston with water being applied directly to one side or the other of the main piston in order to control its reciprocating movement. During the return stroke, water from the underside of the piston is returned through the spool valve before being exhausted from the system.

An apparent limitation of those prior art systems which are known is the inability to increase the quantity of liquid which is provided at the intensified pressure without modification of the system. Pressure multiplication is a function of the ratio of the piston areas, and the quantity of water provided depends on the flow rate of the system as constructed and the rate at which the pistons can be cycled, which in turn is a function of available differential pressure. Where the available pressure head is minimal, the rate of flow is those systems which are referenced hereinabove is also limited.

SUMMARY OF THE INVENTION

In brief, arrangements in accordance with the present invention utilize a pair of different size piston/cylinder combinations mounted in line with a single connecting rod extending between the two pistons. Two water flow control valves are associated with the piston/cylinder combination: a main, cycling, shuttle valve connected to the lower end of the large cylinder for directing driving liquid to and from the lower side of the large piston, and an auxiliary, cycling, control valve mounted to be mechanically driven between alternative control positions by a sliding coupling to the piston rod. The control valve in turn directs water to one side or the other of opposed piston faces in the main shuttle valve to drive the shuttle valve between positions for filling and draining the main cylinder. A pair of check valves in the connections to the upper end of the high pressure cylinder serve alternatively to direct the high pressure liquid to an elevated storage tank on the up stroke of the piston arrangement and to admit water from the low head supply to fill the high pressure cylinder and return the pistons to the bottom of their stroke for the beginning of another cycle.

The high pressure cylinder is mounted in line, coaxially, with the low pressure cylinder by means of a support column which encloses the connecting rod between the two pistons. This support column is in the form of a tube having a longitudinal opening along one side. A cycle control mechanism extends through this opening between a fixed fastening on the connecting rod and a slide which is movable along a control rod extending coaxially of the control valve and between two stops thereon. By virtue of this arrangement, the central spool of the control valve remains in one limit position or the other as the two pistons and piston rod travel back and forth. Only when the pistons reach the limit of travel at one end or the other does the cycle control member reach one of the stops on the rod extending from the control valve. Movement of this control valve rod due to pressure against the operative stop changes the spool to the opposite position, thereby directing water to the main shuttle valve and causing it to shift between a position directing water into the low pressure cylinder and a position permitting water to flow out of the low pressure cylinder.

The particular structural configuration of the present invention is readily adaptable to expansion of capacity by the simple expedient of coupling additional piston/cylinder combinations to respective plenum pipes, effectively providing a plurality of such dual piston pumps in a companion pump battery, all being controlled from a common main shuttle valve which in turn is controlled by its auxiliary control valve. Within practical limits, any number of companion pumps can be added to extend the volumetric capability of the system. Only one of the pumps needs to be associated with a cycling control valve, and a single control valve/shuttle valve combination serves to drive the entire battery of pumps.

BRIEF DESCRIPTION OF THE DRAWING

A better understanding of the present invention may be realized from a consideration of the following detailed description, taken in conjunction with the accompanying drawing in which.

DESCRIPTION OF THE PREFERRED EMBODIMENTS

Figure 1:
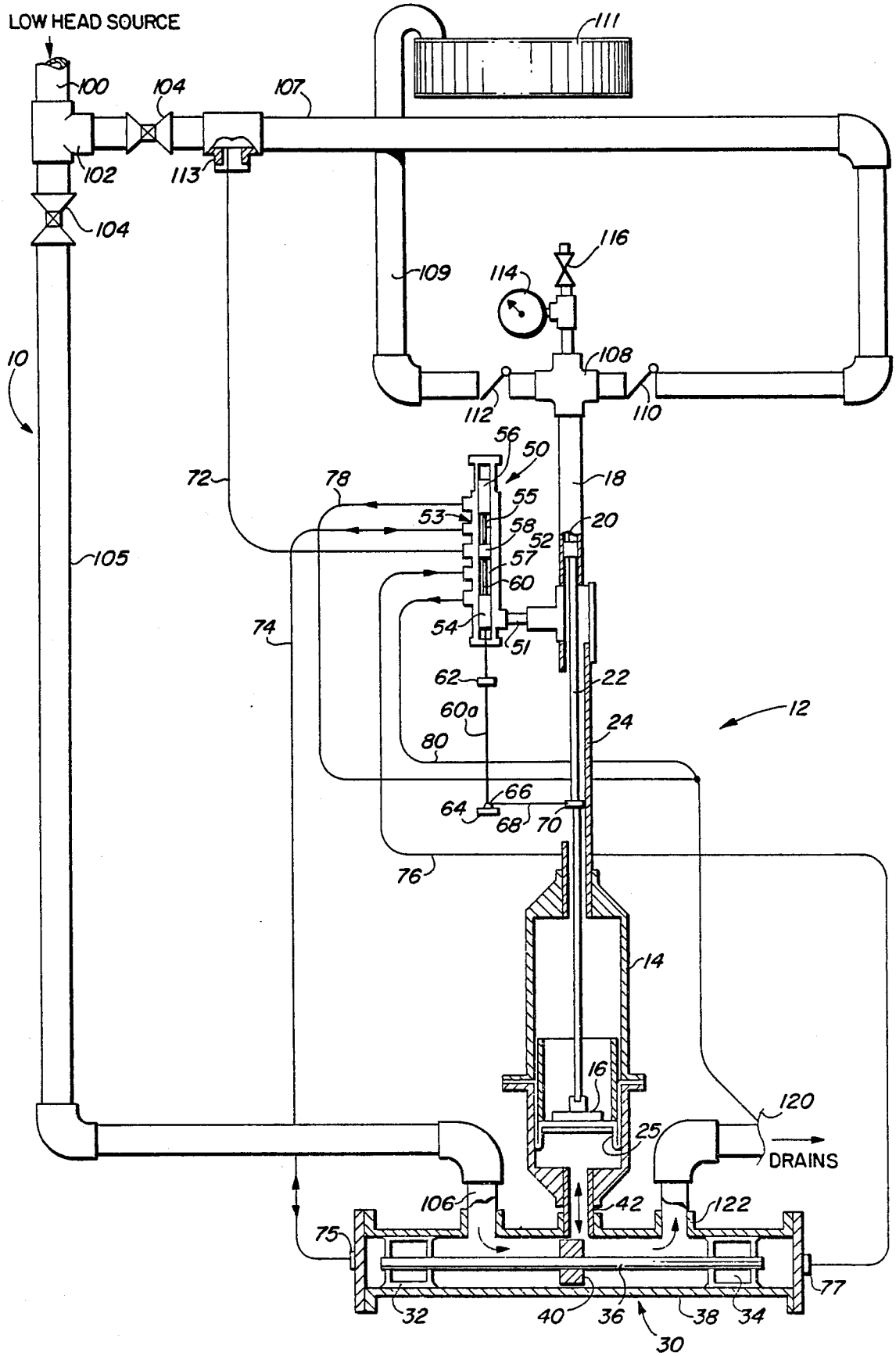
FIG. 1 is a schematic representation of one particular arrangement in accordance with the present invention.

FIG. 1 schematically represents a system 10, principally comprising a dual pump 12 having a low pressure cylinder 14 containing a piston 16 and a high pressure cylinder 18 containing a piston 20. The piston 16 and 20 are connected together by a connecting rod 22 movable within a cylindrical housing 24 in the form of a support column which extends between the cylinders 14 and 18, supporting the high pressure cylinder 18 from the low pressure cylinder 14 and encasing the piston rod 22. The low pressure cylinder 14 is provided with a seal 25 in the form of a commercially available "Bellofram" diaphragm. Rolling flexible diaphragm seals of the type 25 employed in the low pressure cylinder 14 are like those disclosed in McMillan, Jr. U.S. Pat. No. 3,722,506 and Holcomb, Jr. U.S. Pat. No. 3,995,723, for example. The rolling diaphragm 25 provides an effective seal between the portions of the cylinder 14 on opposite sides of the piston 16, yet permits the periphery of the piston 16 to be separated from the inner walls of the cylinder 14 so that the normal sliding friction of the piston/cylinder is essentially eliminated.

Shown coupled to the lower end of the housing for the low pressure cylinder 14 is a main or shuttle valve 30, having a pair of pistons 32 and 34 at opposite ends of a rod 36 which also mounts an intermediate piston 40, all within a cylinder 38. The shuttle valve cylinder 38 is connected to the lower end of the cylinder 14 by a pipe 42.

An auxiliary or control valve 50 is shown mounted adjacent the support column 24 by means of a mounting rod 51. The control valve 50 has a cylindrical housing 52 in which is located a valve spool 53 comprising a bottom piston 54, a top piston 56 and an intermediate piston 58, all being mounted on a piston rod 60 which has an extension **60*a* that extends outwardly of the housing 52. The spool 53 defines an upper chamber 55 and a lower chamber 57 between adjacent pairs of pistons 56, 58 and 54, 58, respectively. A pair of spaced-apart stops 62 and 64 are mounted on the rod extension 60*a*. Between the stops 62, 64 is a ring 66 which is affixed to the piston rod 22 by attachment members 68 and 70. The ring 66 is movable up and down along the extension rod 60*a* between the stops 62, 64 with the movement of the piston rod 22. As the piston rod 22 and associated pistons 16, 20, approach the lower limit of their travel, the ring 66 bears against the stop 64 and moves the rod with attached spool valve members 54, 56 downwardly within the housing 52. Conversely, when the pistons 16, 20 and rod 22 approach the upper limit of their travel within the cylinders 14, 18, the ring 66 bears against the upper stop 62, thereby raising the rod 60*a* and attached spool valve members 54, 56 and 58 to an uppermost position within the housing 52. As the valve spool 53 shifts between the upper and lower positions within the housing 52, it controls the communication path between tubing 72, 74, 76, 78 and 80 to control the flow of water through the control valve 50 which, in turn, controls the position of the shuttle valve 30**.

The system 10 also includes an inlet water line in the form of a pipe 100 connected to a low head water supply. The main line 100 is divided at tee 102, from whence water is carried through a pair of gate valves 104 to an inlet 106 of the shuttle valve 30, via line 105, and via line 107 to an upper end 108 of the high pressure cylinder 18. A pair of check valves (i.e. one way flow valves) 110, 112 are in lines 107 and 109 respectively. The line 109 is the outlet of the high pressure portion of the system 10 and is connected to provide water at the higher pressure to an elevated storage tank 111 where the augmented pressure head may be maintained. The line 107 has a tee 113 from which a feed line 72 is connected to carry low head water to the control valve 50. A pressure gauge 114 and an air bleed valve 116 are connected to the upper end 108 of the high pressure cylinder 18.

Within the housing 52 of the control valve 50 the valve spool 53 determines two chambers 55, 57 on opposite sides of the central piston 58. Tubing 74 extends from the upper chamber 55 to a coupling 75 at the left-hand end of the shuttle valve 30, adjacent the piston 32. A similar line 76 extends from the lower chamber 57 to a similar coupling 77 at the right-hand end of the shuttle valve 30, adjacent the piston 34. Waste lines 78 and 80 also extend from opposite ends of the control valve 50 to drains which are indicated at 120. A pipe connection extends from an outlet 122 of the shuttle valve 30 to the drains 120.

Operation of the system 10 of FIG. 1 may be described as follows: with the shuttle valve 30 in the fill position (rod 36 moved to the right until the piston 40 clears the central pipe 42 leading to the lower end of the low pressure cylinder 14) low pressure water through line 105 and inlet 106 flows into the lower end of the low pressure cylinder 14, below the piston 16 and rolling diaphragm seal 24. The hydraulic force developed by the low pressure head drives the piston 16 to the upper end of the cylinder 14. Prior to upward movement of the piston 16, the high pressure cylinder 18 above the piston 20 will have filled with low pressure water through the line 107 and via check valve 110 while check valve 112 blocks off the high pressure water in the line 109. As the piston 16 starts upward, it drives the piston rod 22 and piston 20. Check valve 110 closes to prevent water from flowing backward into line 107. Check valve 112 opens to permit pressurized water to flow from the cylinder 18 through the line 109 to the elevated storage tank 111.

When low pressure piston 16 reaches the upper limit of its travel, the ring 66 bearing against the stop 62 moves the cycle control rod 60*a*, shifting the control valve 50 to its DRAIN position. In the DRAIN mode, lines 74 and 78 are connected together through the upper chamber 55, lines 72 and 76 are connected together through the lower chamber 57, and the drain line 80 is blocked by the piston 54. Low head water now flows through the lower chamber 57 of the control valve 50 via lines 72, 76 to the right-hand end of the shuttle valve 30, thereby driving the pistons 32, 34 and 40 on rod 36 toward the left-hand end of the shuttle valve 30. Water from the left-hand end of the piston 32 exits the shuttle valve 30 via line 74, upper chamber 55 in control valve 52 and line 78 which carries it to the drains 120. When the piston 40 is moved to the left sufficiently to clear the central pipe 42, it blocks inlet water and allows water at the underside of the piston 16 to drain through the outlet 122 to the drains 120. Check valve 112 closes to prevent the high pressure water from returning, and inlet water from the low head source is permitted to flow through line 107 and check valve 110 into the upper end of the high pressure cylinder 18, where it serves to drive the piston 20 downwardly, thus carrying the rod 22 and piston 16 back to the lower limit of travel. At that point, the ring 66 encounters the stop 64 and drives the cycle control rod 60*a* to its lowermost position, thereby shifting the spool 53 within the housing 52 to block the drain line 78, interconnect the inlet line 72 and actuator line 74 via chamber 55, and also interconnect the line 76 with the drain line 80 via chamber 57. In this control valve position, corresponding to the PUMP mode, water flowing through the line 74 drives the pistons 32, 34, and 40 with rod 36 to the right-hand end of the shuttle valve 30. As soon as the piston 40 clears the opening of the central pipe 42, low head water is permitted to flow into the lower end of the low pressure cylinder 14, and the cycle is repeated.

The power delivered by the system 10 is equal to the product of the effective area of the rolling diaphragm 24, the pressure head of the source liquid, and the length of the piston stroke divided by the time for the stroke cycle. Because the low pressure cylinder 14 is a separate, self-contained unit, any device capable of utilizing reciprocating mechanical power may be connected thereto. For example, it would be possible to replace the high pressure cylinder 18 and piston 20 with electrical generating equipment or with any other mechanical device requiring a reciprocating power input.

The system 10 as shown in FIG. 1 is a pressure amplifying pump that uses large volumes of low pressure liquid as an energy source and delivers water at a pressure multiplied from 1.3 to 85.4 times the low pressure head in one particular embodiment. The system operates satisfactorily on as little as 10 feet of head, which is approximately five psig. It is particularly useful in remote locations, Third World countries, and like regions where plentiful supplies of water at limited head pressure are available but power for pumping stations to deliver water at suitable main pressures is scarce or non-existent and the areas are out of reach of standard water mains.

Figure 2:
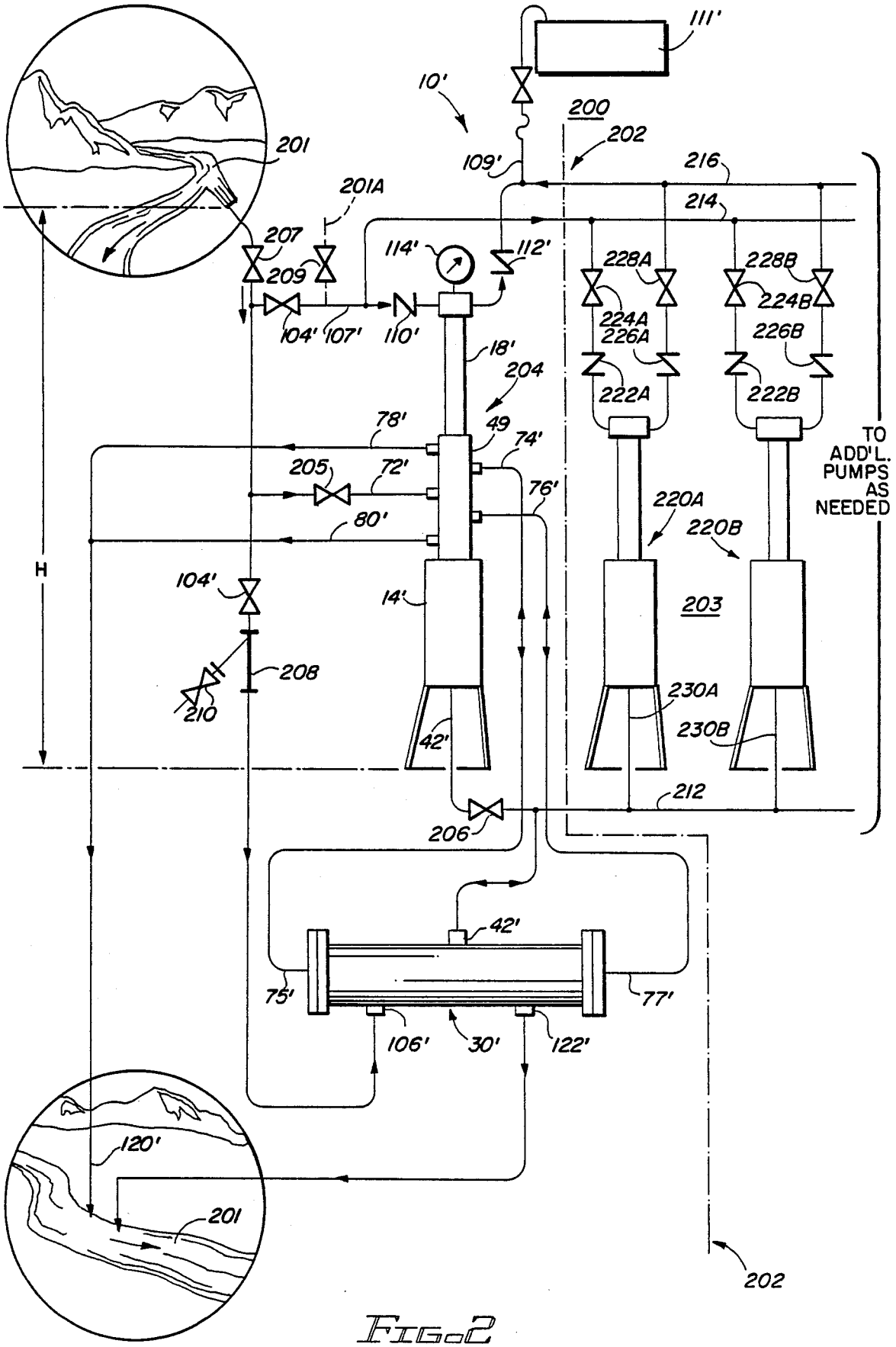
FIG. 2 is a schematic representation of another particular arrangement in accordance with the present invention.

FIG. 2 illustrates in schematic form a system 200 in accordance with the present invention having a plurality of simplified pumps connected in a companion pump battery to a system such as that shown in FIG. 1 including the main shuttle valve and auxiliary control valve. In the arrangement of FIG. 2, a single control valve and a single shuttle valve are sufficient to control the operation of all of the pumps in a given battery.

In FIG. 2, the system 200 is shown taking water from a river 201 as the low pressure head source. With both valves 104' open, the river water is both the pumping fluid and the water being pumped. The broken line 201A indicates the possibility of using an alternate source of water to be pressurized, such as may be available from a well or the like. In such an arrangement, with upper valve 104' closed and valve 209 open, the river water 201 serves to pump well water from source 201A to the higher, useful pressure, even where the source 201A may have a lower head than the river 201. In FIG. 2, that portion of the system 200 shown to the left of the central broken line 202 corresponds to the system 10 of FIG. 1, and like elements thereof have been designated by corresponding reference numerals with a prime mark added. The primary system 10' shows the low pressure cylinder 14', the high pressure cylinder 18' and integral cycling control valve 49 (FIG. 3) as making up a pump battery cycle control pump 204. Gate valves 205, 206, 207 and 210 are added, together with a filter 208 of approximately 100 mesh which is provided to remove silt and sand from water flowing to the main shuttle valve 30'. Valve 206 is a flow control valve provided in the main flow line to control synchronous operation of the pumps in the system 200 of FIG. 2.

The portion of the system 200 to the right of the broken line 202 comprises a plurality of pumps 220 making up a companion pump battery 203. Two such pumps, 220A and 220B, are shown, although additional pumps as needed may be added. The pumps 220 are connected via individual low pressure flow lines 230 to a low pressure plenum line 212. Each of the pumps 220 is like the pump 204, except for the control valve 49 which is not needed, and therefore not present, in the pumps 220. The upper end of each of the pumps 220 is connected to the low pressure inlet line 107' and upper low pressure plenum line 214 via an individually associated check valve 222 and gate valve 224. The upper end of each pump 220 is also coupled to a high pressure plenum line 216 via associated check valve 226 and gate valve 228.

Figure 3:
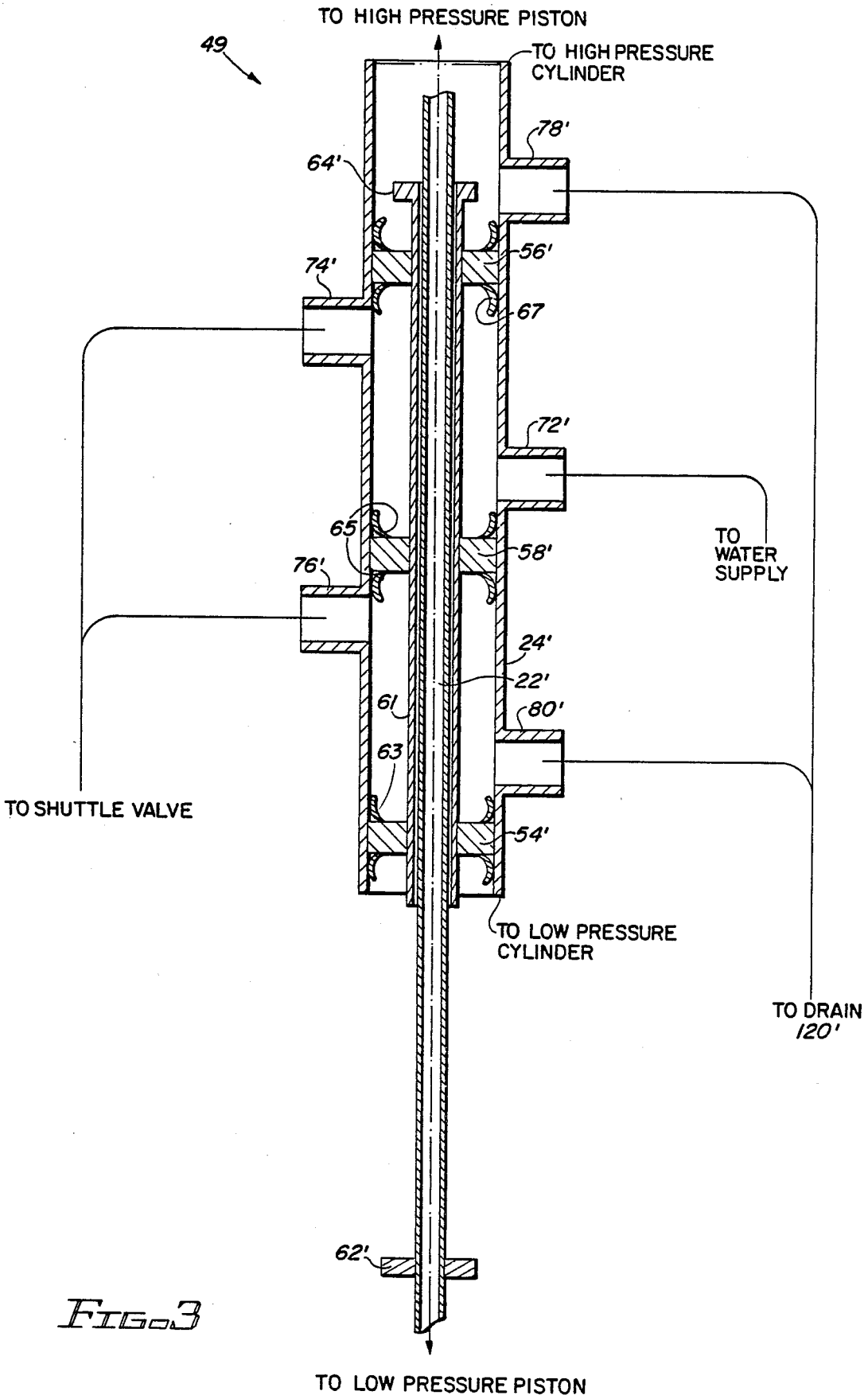
FIG. 3 is a schematic diagram of a portion of FIG. 2, showing details of the integral control pump thereof.

FIG. 3 shows details of the integral cycling control valve 49 of FIG. 2. The integral control valve 49 of FIG. 3 is like the control valve 50 of FIG. 1, except that it is constructed internally of the support column 24 which extends between the low pressure cylinder 14 and the high pressure cylinder 18. As depicted in the schematic diagram of FIG. 3, the control valve 49 is functionally equivalent to the control valve 50 of FIG. 1 and its interaction with the rod 22. In FIG. 3 corresponding elements are identified by the same reference numerals of FIG. 1, followed by a prime indicator.

Thus, in FIG. 3, rod 22' is mounted for reciprocating movement within an extension 24' of the low pressure cylinder serving as the support column for the high pressure cylinder. The rod 22' has a pair of adjustable shaft collars 62' and 64' affixed thereto and moves up and down within a hollow cylindrical spool member 61. A plurality of pistons 54', 56' and 58' are mounted on the spool member 61, together with seals 63, 65 and 67. The entire spool assembly is movable along the support column 24' to change the interconnections between the various ports 72' leading to the water supply, 74' and 76' leading to the shuttle valve 30 (FIG. 1) and 72', 80' leading to the drain 120'. Adjustable collars 62' and 64' are mounted on the rod 22' and are set to control the movement of the spool assembly when the piston rod approaches the limit of its travel in either direction. The arrangement of FIG. 3 thus functions in correspondence with the control valve of FIG. 1 but with all of the respective elements integrally mounted within the high pressure cylinder support column 24'.

In operation of the system 200 of FIG. 2 by drawing water from the river 201, gate valves 207 and 104' are opened, as is also the phase control valve 206. Operation of the basic system portion 10' of the overall system 200 proceeds in the manner described in connection with system 10 of FIG. 1. Additional pumps 220 in the companion pump battery 203 can be brought on line by opening gate valves 224 and 228 for each such pump. Each pump 220 which is brought on line operates in phase with the pump 204, since the pumps are connected to the low pressure plenum line 212 which is controlled by the main shuttle valve 30'.

Another possible use of systems in accordance with the present invention is as a proportional or ratio mixer of fluids. For example, liquid fertilizer can be added to irrigation water in a very small but precisely controlled ratio. Similarly, such a system can be used in the purification system for a municipal water treatment plant by adding chlorine or other chemicals as desired in precisely controlled proportional amounts. Modification of the present invention for this purpose is illustrated in FIG. 4, which shows an adaptation of the system of FIG. 2.

Figure 4:
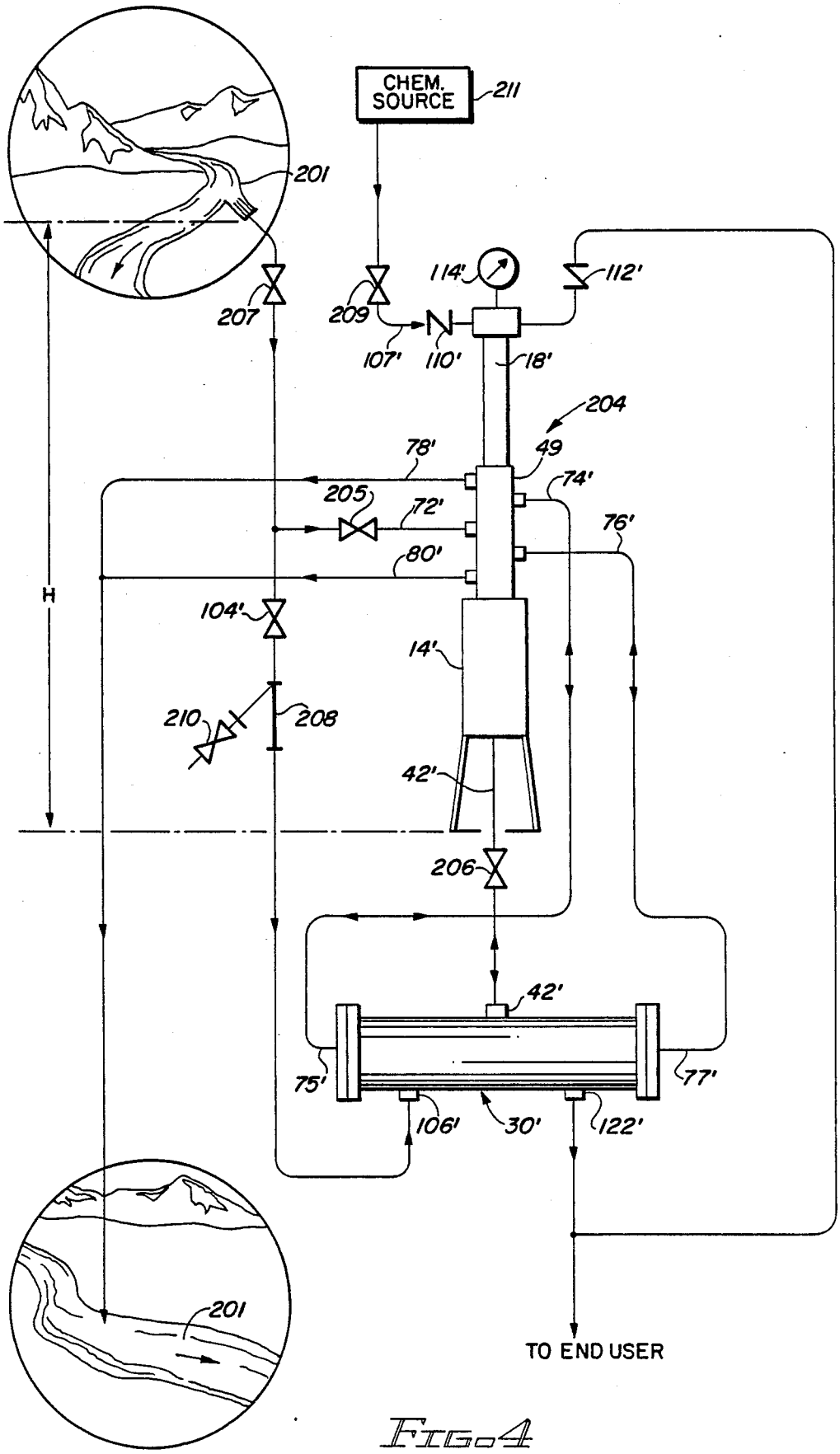
FIG. 4 is a schematic diagram of still another arrangement in accordance with the present invention.

In FIG. 4, the same combination of large cylinder/-piston 14' in conjunction with small cylinder/piston 18', control valve 49 and shuttle valve 30' as in FIG. 2 is shown, together with associated valving and other elements. The differences between FIGS. 2 and 4 are the absence of any connection from the inlet water source via valve 207 to the line 107' and the absence of return of the cycling water to the river 201 at the lower end of the figure. Instead, the line 107' is coupled via a valve 209 to a source 211 of a selected chemical. Also, the storage reservoir for pressurized liquid at the outlet of the valve 112' is absent. Instead, the outlet of the valve 112' is combined with the outlet line from the port 122' of the shuttle valve 30'. This combined flow from the port 122' and the valve 112' is supplied to an end user with the proportional mixture of chemicals from the source 211 as determined in accordance with the operating ratio of the pumping system; i.e , the ratio of the areas of the cylinders 18', 14'. In this application of the invention, the system is no longer used for substantially increasing the pressure of liquid from the small cylinder 18'; rather, the system is utilized to provide a proportional flow rate between water flowing through the lower cylinder 14' which ultimately flows out of the control valve 30' through the port 122' and the liquid from the source 211-which is metered into the larger flow through the cylinder 18' and the action of the check valves 110', 112'.

Systems in accordance with the present invention are relatively inexpensive, easy to maintain and reliable in service over long periods of time. These pumping systems are effective in operation at inlet head pressures, indicated as H in FIG. 2, as low as 10 feet or approximately 5 psig. Such a system can provide water to an elevated storage tank at pressures in a range of from 6 to 2000 psig. As an added feature of the present invention, the flow capacity of water at the intensified pressure can be multiplied at reduced cost by the simple expedient of adding simple dual pressure pumps in a companion pump battery coupled to a single pump basic system without the need for multiplying the cost of the shuttle valve and control valve associated with the basic system.

Although there have been described above specific arrangements of a pressure amplifying pump system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A fluid pumping system comprising:

a dual pump having a relatively large diameter piston/cylinder combination coupled to a relatively small diameter piston/cylinder combination for movement of the pistons together in unison;

a cycling shuttle valve coupled to the relatively large diameter cylinder and controllable between first and second positions respectively transferring a first fluid into and out of the relatively large diameter cylinder on only the side of the relatively large diameter piston which is remote from the relatively small diameter piston, said shuttle valve constituting the only means for directing fluid into said large diameter cylinder to apply pressure to said side of the large diameter piston;

cycle control valving means for selectively driving the shuttle valve between said first and second positions in correspondence with movement of said pistons;

sensing means associated with said valving means and being responsive to the position of the intercoupled pistons for controlling the valving means;

means for conducting the first fluid from a first fluid source to the control valving means and the shuttle valve, respectively;

tubing coupled between respective portions of the valving means and corresponding portions of the shuttle valve for conducting fluid therebetween;

means for conducting other fluid separating from said shuttle valve and said large diameter cylinder over a first one-way flow path to one end of the relatively small diameter cylinder; and means for conducting said other fluid from said one end of the relatively small diameter cylinder over a second one-way flow path for providing a proportional rate of flow of the other fluid, relative to the flow rate of the first fluid, in proportion to the ratio of cylinder areas of the relatively small diameter cylinder to the relatively large diameter cylinder.

2. A pumping system in accordance with claim 1 for providing said other fluid at an amplified pressure relative to the pressure of the first fluid wherein the relatively large diameter piston/cylinder combination is operated as a low pressure unit, wherein the relatively small diameter piston/cylinder combination is operated as a high pressure unit, and wherein both of the fluids are water.

3. The system of claim 2 wherein said low pressure piston/cylinder combination further includes a rolling diaphragm seal extending between the periphery of the low pressure piston and the interior wall of the cylinder to prevent water from passing from one side of said piston to the other.

4. The system of claim 2 wherein said cylinders are coupled together by fixed connecting means and the low pressure piston and high pressure piston are coupled together by a connecting rod.

5. The system of claim 4 wherein said sensing means comprise a movable member which is connected to said connecting rod for movement therewith.

6. The system of claim 4 wherein said sensing means further comprise a control rod extending from the valving means and having a pair of stops mounted thereon on opposite sides of said movable member which are capable of being driven by said movable member at respective positions corresponding to the limits of travel of said connecting rod.

7. The system of claim 6 wherein the fixed connecting means comprise a support tube extending between the two cylinders and having a longitudinal aperture through which said movable member extends outwardly from its connection to the connecting rod.

8. The system of claim 2 wherein the shuttle valve comprises a cylinder enclosing a pair of opposed pistons on opposite ends of a rod and an an intermediate piston mounted between the two opposed pistons, an inlet line connected to said cylinder between a first one of said opposed pistons and said intermediate piston, an outlet line connected to said cylinder between a second one of said pair of opposed pistons and said intermediate piston, and a pipe connected between said low pressure cylinder and the approximate mid-point of the shuttle valve cylinder, the intermediate piston being located to block water flow between the inlet line and said low pressure cylinder while permitting water flow between the low pressure cylinder and the outlet line in the first position of the shuttle valve and being located to permit water flow between the inlet pipe and the low pressure cylinder while blocking water flow between the low pressure cylinder and the outlet line in the second position of the shuttle valve.

9. The system of claim 8 wherein the valving means comprise a cylinder having a plurality of ports along one side thereof and enclosing a valve spool defining a pair of separate chambers, said spool being movable in response to said sensing means to selectively interconnect and block water flow through said ports via said chambers.

10. The system of claim 9 wherein said valve spool is effective, when in a position corresponding to the lower limit of travel of said connecting rod, to direct water from a low pressure port to one of said tubes to the end of the shuttle valve adjacent said first piston via a first one of said chambers and to permit the flow of water from the other tube which is connected to an opposite end of the shuttle valve adjacent the second piston with a drain tube via the second one of said chambers in order to permit said water flow to drive the piston and rod combination of the shuttle valve from said first position to said second position.

11. The system of claim 2 further including additional pumping means coupled between the intermediate pipe of the shuttle valve and the separate first and second one-way flow paths for increasing the pumped water flow capacity of said system.

12. The system of claim 11 wherein said additional pumping means comprise at least one additional dual pump having a combination coupled to a high pressure piston/cylinder combination for movement of the pistons in unison.

13. The system of claim 12 further including a plenum pipe connected to said intermediate pipe, and means for causing the additional pumping means to operate in phase synchronism with the first-mentioned dual pump.

14. The system of claim 13 wherein each of said additional pumping means includes a pair of one-way flow control valves coupled to one end of the high pressure cylinder, one of said one-way flow control valves being connected to a low pressure plenum pipe for admitting low pressure water to said end of the high pressure cylinder, the other of said one-way flow control valves being connected to a high pressure plenum for directing water at amplified pressure from the high pressure cylinder to a utilization device.

15. The system of claim 1 wherein the other fluid is a liquid chemical to be mixed with the first fluid in a predetermined proportionality ratio, and further including a conduit connected between the second one-way flow path and an exit port of the shuttle valve for mixing with the first fluid as it exits the shuttle valve after cycling through the relatively large diameter cylinder.

16. The system of claim 15 wherein said other fluid is mixed with the first fluid in proportion to the ratio of the area of the small diameter cylinder to the area of the large diameter cylinder after the first fluid leaves the large diameter cylinder.

17. The system of claim 16 wherein the first fluid is irrigation water and the other second fluid is liquid fertilizer to be mixed with the irrigation water in said proportion.

18. The system of claim 16 for use in treating a municipal water supply, wherein the first fluid is water and the other fluid comprises an additive to the water system.

19. The system of claim 18 wherein the other fluid is chlorine.

* * * * *